US009168399B2

(12) United States Patent
Aldred et al.

(10) Patent No.: US 9,168,399 B2
(45) Date of Patent: Oct. 27, 2015

(54) DESCENT DEVICE WITH AUTOMATIC AND MANUAL CONTROL

(75) Inventors: Jeffrey Kent Aldred, Boulder, CO (US); Alexis Stuart Foreman, Boulder, CO (US); Palmer Hubbard Beam, Boulder, CO (US); James E. Fay, Boulder, CO (US)

(73) Assignee: DEUS Rescue GmbH, Bietigheim-Bissingen (DE)

( * ) Notice: Subject to any disclaimer, the term of this patent is extended or adjusted under 35 U.S.C. 154(b) by 355 days.

(21) Appl. No.: 13/142,320

(22) PCT Filed: Jan. 6, 2010 (Under 37 CFR 1.47)

(86) PCT No.: PCT/US2010/020268
§ 371 (c)(1), (2), (4) Date: Aug. 6, 2013

(87) PCT Pub. No.: WO2010/080842
PCT Pub. Date: Jul. 15, 2010

(65) Prior Publication Data

US 2014/0299411 A1 Oct. 9, 2014

Related U.S. Application Data

(60) Provisional application No. 61/142,873, filed on Jan. 6, 2009, provisional application No. 61/153,213, filed on Feb. 17, 2009.

(51) Int. Cl.
*A62B 1/10* (2006.01)

(52) U.S. Cl.
CPC ..... *A62B 1/10* (2013.01)

(58) Field of Classification Search
CPC ..... A62B 1/10
USPC ..... 182/241
See application file for complete search history.

(56) References Cited

U.S. PATENT DOCUMENTS

| | | | | | |
|---|---|---|---|---|---|
| 139,484 | A | * | 6/1873 | Talpey | 182/241 |
| 338,750 | A | * | 3/1886 | Johnson | 182/192 |
| 573,739 | A | * | 12/1896 | Wethered | 182/191 |
| 574,580 | A | | 1/1897 | Serve | |
| 773,355 | A | * | 10/1904 | Vieregg | 182/241 |
| 1,798,844 | A | * | 3/1931 | Johansson | 254/391 |
| 4,359,139 | A | | 11/1982 | Bloder | |
| 4,655,327 | A | * | 4/1987 | Tomioka et al. | 188/290 |
| 5,127,490 | A | * | 7/1992 | Sheu | 182/5 |
| 5,701,972 | A | * | 12/1997 | Bloder | 182/234 |
| 5,722,612 | A | | 3/1998 | Feathers | |
| 6,092,791 | A | * | 7/2000 | Kingery | 254/371 |
| 2005/0023085 | A1 | * | 2/2005 | Munton | 182/239 |
| 2006/0017047 | A1 | | 1/2006 | Calver | |

* cited by examiner

*Primary Examiner* — Alvin Chin-Shue
(74) *Attorney, Agent, or Firm* — Michael J. Striker

(57) ABSTRACT

A descent device according to embodiments of the present invention includes a housing; an inlet capstan; a drive wheel coupled to a centrifugal brake, the drive wheel rotatable with respect to the housing about an axis, the drive wheel including a groove formed along its outer perimeter, the groove having a first inner side wall, a second inner side wall, and a bottom, a distance between the first and second inner side walls decreases from the outer perimeter to the bottom in a direction toward the axis, wherein at least a portion of a radial extent of the inner side walls includes a pattern of protrusions positioned between inner side walls to form an irregular rope path along the groove; an outlet capstan; and a rope extending through the rope inlet, around the inlet capstan, around the drive wheel, around the outlet capstan, and through the rope outlet.

7 Claims, 10 Drawing Sheets

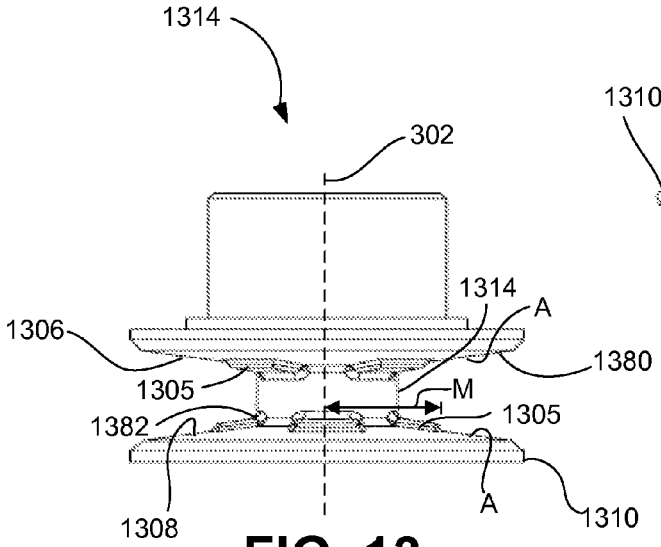
FIG. 13
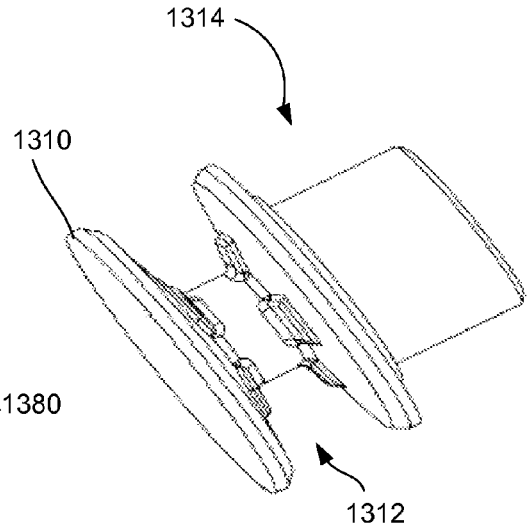
FIG. 14
FIG. 15
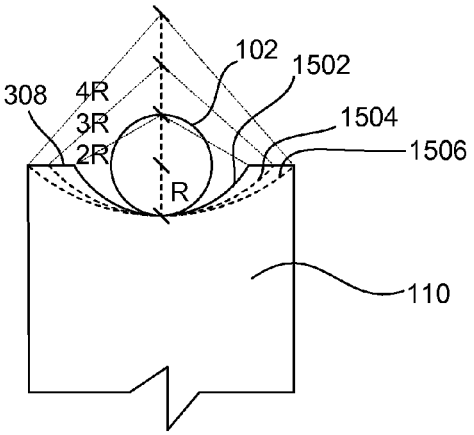

DESCENT DEVICE WITH AUTOMATIC AND MANUAL CONTROL

CROSS REFERENCE TO RELATED APPLICATIONS

This application claims the benefit of U.S. Provisional Patent Application Ser. No. 61/142,873, filed on Jan. 6, 2009, and 61/153,213, filed on Feb. 17, 2009, which are incorporated herein by reference in their entirety for all purposes.

TECHNICAL FIELD

Embodiments of the present invention relate generally to rescue devices, and more specifically to systems and methods for rapid descent.

BACKGROUND

A person can descend quickly from a height by using a rope and a rapid descent device that provides a braking force to counteract the person's weight on the rope. Such devices may be used, for example, by civilians evacuating a building via an exterior of the building, such as when all other exits are blocked or no longer available. Such devices may also be used, for example, by firefighters and/or rescue workers descending rapidly from a burning building, and/or by any person working at a height.

Existing rapid descent devices often include simple drive wheels capable of being driven at a single speed equivalent to the rope speed. The braking force imparted by such rapid descent devices is thus the same for a very heavy load and a very light load, for any given rope speed. Such devices also typically do not permit rope slippage during shock loading or manual rope advancement.

SUMMARY

According to some embodiments of the present invention, a descent device has a multiplicity of braking elements which include a rope-driven automatic energy dissipating device (RDAEDD) such as, for example, a centrifugal brake, several strategically-placed capstans that dissipate energy according to the Euler friction equation, and a system to generate inlet friction on the rope.

According to some embodiments of the present invention, a RDAEDD is used in combination with a capstan on both sides of the RDAEDD such that the capstan before the RDAEDD acts to increase the effective friction on the rope-drive unit connected to the RDAEDD to minimize slip between the rope and the drive wheel, while the capstan after the RDAEDD acts as a multiplier to the effect of the RDAEDD. According to some embodiments of the present invention, the two capstans themselves act as a brake; tension on the inlet rope is multiplied by each capstan, giving the operator a brake force that is dependant only on any friction present in the inlet side of the device. The RDAEDD is of benefit to provide a variable back tension to the final capstan, thereby limiting the descent speed of the device to an acceptable level, according to embodiments of the present invention.

According to some embodiments of the present invention, a RDAEDD is used in combination with a capstan before the RDAEDD to prevent slip between the rope and drive wheel. According to some embodiments of the present invention, a RDAEDD is used in combination with a capstan after the RDAEDD to act as a multiplier to the effect of the RDAEDD. Some embodiments of the present invention include a rope inlet tensioning device.

According to some embodiments of the present invention, a rope inlet tensioning device performs such that pulling on either end of the rope entering or exiting the device while the inlet and exit ropes are essentially parallel to each other and to the centerline of the device causes the inlet rope tension to substantially lessen and/or disappear, making it possible for a person to manually pull rope through the device in either direction with very little effort. More generally, according to some embodiments of the present invention, a rope inlet tensioning device performs such that rope inlet tension can be substantially lessened and/or made to disappear if the device is rotated or the rope is pulled in a way that will not occur when the device is loaded, making it possible for a person to manually pull rope through the device with little effort. According to some embodiments of the present invention, this can be done in either direction, and in other embodiments it can be done in one direction.

According to some embodiments of the present invention, capstans and/or other elements in the device that create friction against the rope are made of a material with a heat transfer coefficient that is significantly less than the heat transfer coefficient of the body of the device, so that heat generated as a result of the rope running over the capstans is transferred into the rope rather than into the device, which keeps the device at a relatively cool operating temperature. According to some embodiments of the present invention, the capstans in the device are made of titanium to have a consistent coefficient of friction (COF) throughout descent and so the difference between COF-static and COF-dynamic is nearly the same. According to some embodiments of the present invention, the capstans in the device are made of titanium to have a consistent coefficient of friction (COF) throughout descent and even with fluctuations in temperature such that the difference between COF-static and COF-dynamic is minimized.

According to some embodiments of the present invention, the rope surface on the capstans is substantially flat or dished with a radius that is at least two times the radius of the rope. According to some embodiments of the present invention, a drive wheel in the descent device is used to drive the RDAEDD. The drive wheel may include a V-groove with protrusions into the V-groove that force or encourage the rope into a serpentine path, which minimizes potential slip between the rope and the drive wheel under heavier load conditions. The V-groove causes the rope to push deeper into the drive wheel with greater load, according to embodiments of the present invention. When the rope is driven deeper into the drive wheel with greater load, the angular velocity of the drive wheel increases for a given rope speed, and faster angular velocity increases the braking force of the RDAEDD, according to embodiments of the present invention. The result is that increased load increases the braking force of the RDAEDD independent of rope speed, according to embodiments of the present invention.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 13 illustrates a front elevation view of an alternative drive wheel, according to embodiments of the present invention.

FIG. 14 illustrates a front perspective view of the alternative drive wheel of FIG. 13, according to embodiments of the present invention.

FIG. 15 illustrates a partial cross-sectional view of a capstan with a dish formed on the rope travel surface, taken along line A-A of FIG. 3, according to embodiments of the present invention.

Figure 1:
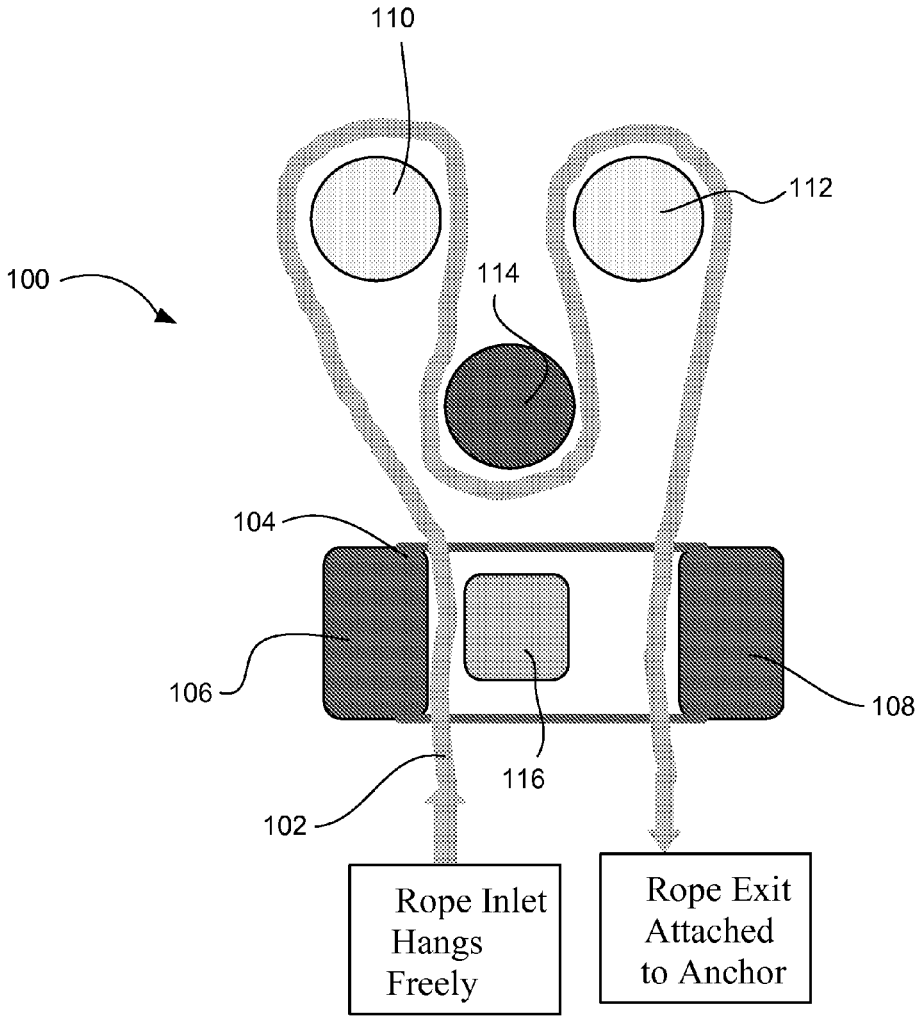
FIG. 1 illustrates a front view of a conceptual diagram of a rapid descent device 100, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
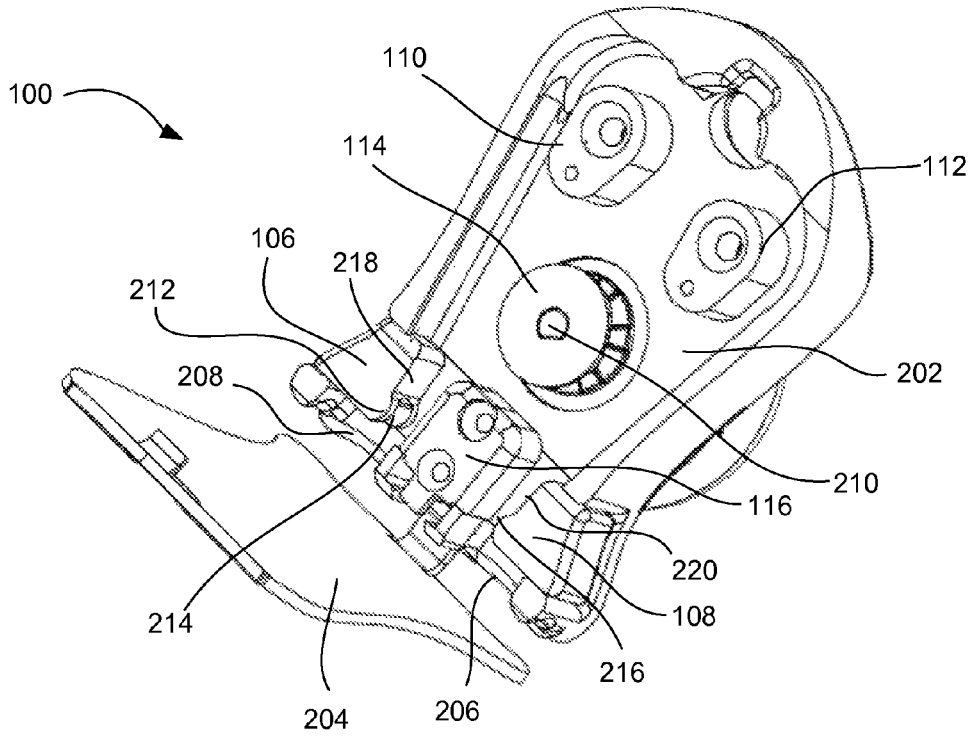
FIG. 2 illustrates a front perspective view of a rapid descent device, according to embodiments of the present invention.

FIG. 1 illustrates a front view of a conceptual diagram of a rapid descent device 100, according to embodiments of the present invention. FIG. 2 illustrates a front perspective view of a rapid descent device 100 with a base (e.g. casing) 202, capstans 110, 112 rigidly affixed to the base 202, a lid 204 hinged to the base 202 with rope 102 openings 206, 208, an RDAEDD mounted to the base 202 with a shaft 210 protruding through the base 202 and a drive wheel 114 attached to the shaft 210 (such that the rotational velocity of the drive wheel 114 matches that of the shaft 210), an anvil 116 rigidly coupled to the base 202, and a sliding cam assembly with a left cam 106 and a right cam 108, according to embodiments of the present invention. The drive wheel 114 rotates with respect to the base 202 about drive wheel axis 302 (see FIG. 3), according to embodiments of the present invention.

Opening 208 may be referred to as a rope inlet 208, and opening 206 may be referred to as a rope outlet 206, according to embodiments of the present invention. Based on the disclosure provided herein, one of ordinary skill in the art will appreciate that the rope inlet 208 and outlet 206 may be reversed by reversing the direction of the braking force of the RDAEDD, and/or by using a reversible RDAEDD, according to embodiments of the present invention. Capstan 110 may be referred to as an inlet capstan 110, and capstan 112 may be referred to as an outlet capstan 112, according to embodiments of the present invention.

The base 202 may also be referred to as a housing 202; housing 202 may be formed of a rigid material. Capstans 110, 112 may be coupled to the housing; for example, capstans 110, 112 may be rigidly coupled to the housing by, for example, bolts, screws, adhesive, and/or welding, according to embodiments of the present invention.

As used herein, the term "coupled" is used in its broadest sense to refer to elements which are connected, attached, and/or engaged, either directly or integrally or indirectly via other elements, and either permanently, temporarily, or removably. As used herein, the term "rotatably coupled" is used in its broadest sense to refer to elements which are coupled in a way that permits one element to rotate with respect to another element. As used herein, the term "slidably coupled" is used in its broadest sense to refer to elements which are coupled in a way that permits one element to slide or translate with respect to another element.

Figure 3:
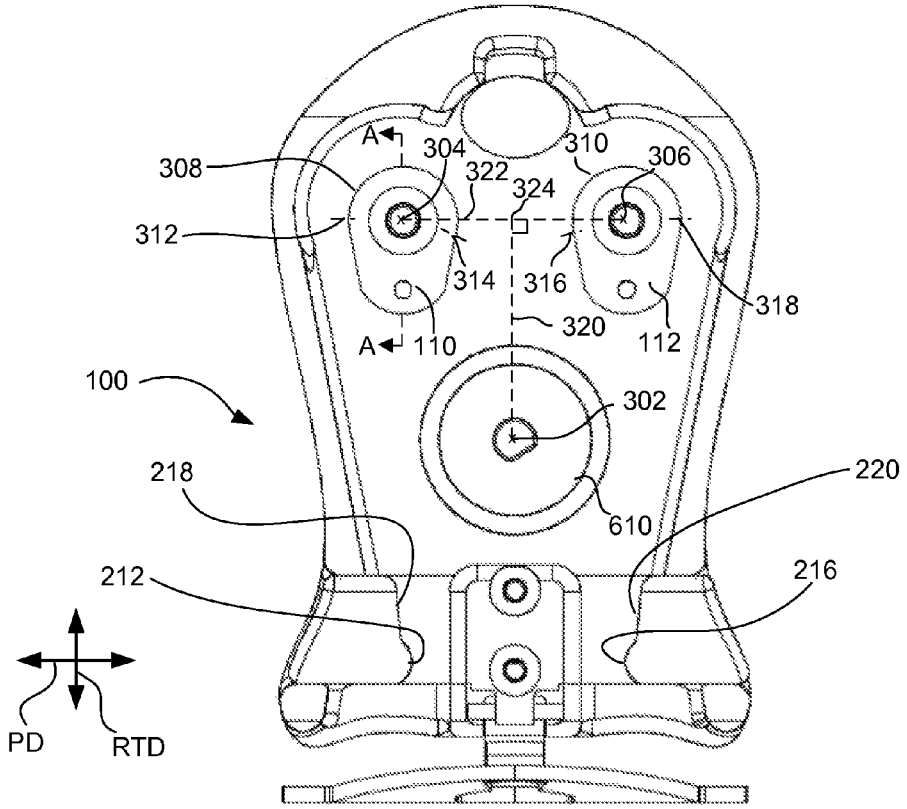
FIG. 3 illustrates a front plan view of the rapid descent device of FIG. 2, according to embodiments of the present invention.
Figure 8:
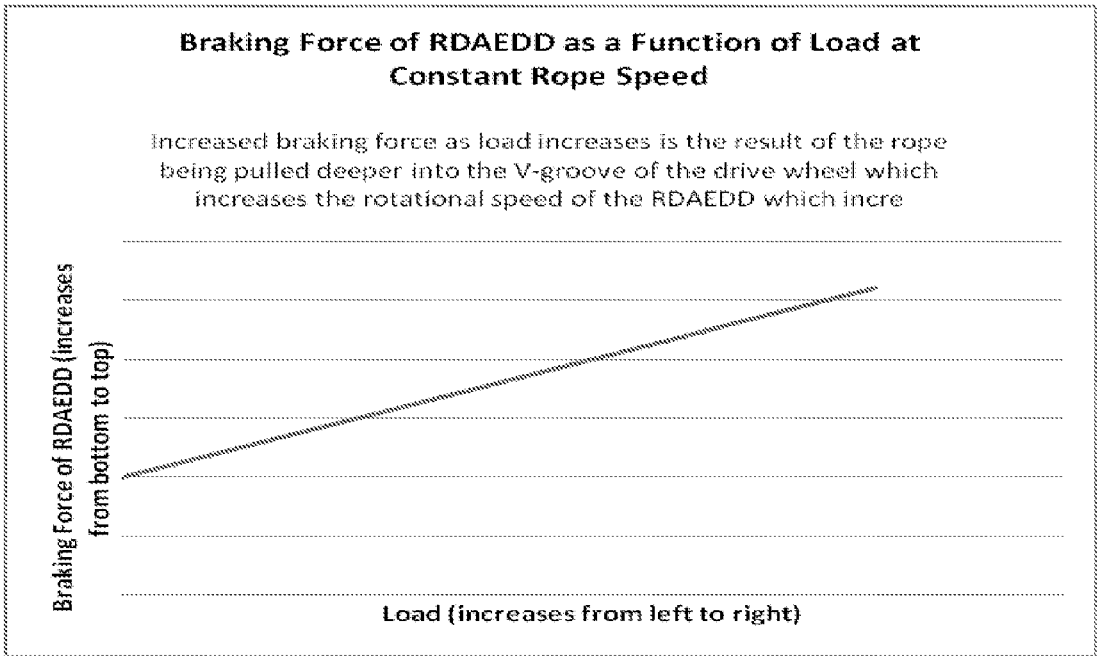
FIG. 8 illustrates a graph showing braking force vs. load for an RDAEDD, according to embodiments of the present invention.

The sliding cam assembly 104, which may be slidably coupled with the housing 202, may include an inlet face 218 and an outlet face 220; the inlet face 218 may form at least part of the rope inlet 208 and the outlet face 220 may form at least part of the rope outlet 206, according to embodiments of the present invention. The inlet face 218 may include an inlet protrusion 212 (as illustrated in FIG. 3) extending from the inlet face 218 into the rope inlet 208 in a direction PD substantially perpendicular to a rope travel direction RTD. The outlet face 220 may include an outlet protrusion 216 (as illustrated in FIG. 3) extending from the outlet face 220 into the rope outlet 206 in a direction PD substantially perpendicular to a rope travel direction RTD. Each of the protrusions 212, 214 may be configured to reduce friction between its respective face 218, 220 and rope when the rope is manually pulled through the descent device. Each of the protrusions 212, 214 may also include a dish 214 (as illustrated in FIGS. 2 and 8) formed substantially along the rope travel direction, which may assist in placement of the rope over the protrusion 212, 214, according to embodiments of the present invention. Although protrusions 212, 214 are illustrated, an indentation (not shown) may alternatively be formed extending into the respective inlet face 218 and outlet face 220 in a direction PD substantially perpendicular to the rope travel direction RTD, according to embodiments of the present invention. Such an indentation may also be configured, similarly to a protrusion, to reduce friction between the respective face 218, 220 and rope when the rope is manually pulled through the descent device.

FIG. 3 illustrates a front plan view of the rapid descent device 100 of FIG. 2, according to embodiments of the present invention. The inlet capstan 110 may include an inlet rope travel surface 308 and an inlet capstan axis 304, according to embodiments of the present invention. The inlet rope travel surface 308 is the surface of the capstan 110 that contacts the rope 102 as the rope travels in the rope inlet 208, around capstan 110, and around drive wheel 114. According to some embodiments of the present invention, the inlet capstan axis 304 is substantially parallel with the drive wheel axis 302, and the inlet rope travel surface 308 includes a radius of curvature about the inlet capstan axis 304. The inlet rope travel surface 308 may span approximately two hundred degrees, for example from point 312 to point 314, and the inlet rope travel surface 308 may include points that are equidistant from the inlet capstan axis 304, according to embodiments of the present invention.

FIG. 15 illustrates a partial cross-sectional view of capstan 110 taken along line A-A of FIG. 3, according to embodiments of the present invention. According to embodiments of the present invention, the inlet rope travel surface 308 may include a dish, as illustrated in FIG. 15. Rope 102 is shown in FIG. 15 as having a radius R; a dish 1502 formed in the inlet rope travel surface 308 includes a radius of curvature 2R, or twice the rope radius, according to embodiments of the present invention. According to other embodiments of the present invention, the inlet rope travel surface 308 includes a dish 1504 having a radius of curvature of 3R, or three times the rope radius. According to yet other embodiments of the present invention, the inlet rope travel surface 308 includes a dish 1506 having a radius of curvature 4R, or four times the rope radius. According to some embodiments of the present invention, the inlet rope travel surface 308 does not include any dish, and is thus substantially flat along its length (about the radius of curvature about the capstan axis 304).

Based on the disclosure provided herein, one of ordinary skill in the art will recognize the various radii of curvature that may be imparted to a dish formed in the inlet rope travel surface 308. The outlet capstan 112 may include an outlet rope travel surface 310 and an outlet capstan axis 306, according to embodiments of the present invention. The outlet rope travel surface 310 is the surface of the capstan 112 that contacts the rope 102 as the rope travels from the drive wheel 114, around the outlet capstan 112, and through the rope outlet 206. According to some embodiments of the present invention, the outlet capstan axis 306 is substantially parallel with the drive wheel axis 302, and the outlet rope travel surface 310 includes a radius of curvature about the outlet capstan axis 306. The outlet rope travel surface 310 may span approximately two hundred degrees, for example from point 316 to point 318, and the outlet rope travel surface 310 may include points that are equidistant from the outlet capstan axis 306, according to embodiments of the present invention. According to embodiments of the present invention, the outlet rope travel surface 310 may be substantially flat and/or include a dish as described above with respect to FIG. 15.

According to embodiments of the present invention, an imaginary line segment 320 (see FIG. 3) drawn from the drive wheel axis 302 to a midpoint 324 of another imaginary line segment 322 between the inlet capstan axis 304 and the outlet capstan axis 306 intersects the imaginary line segment 322 at a right angle. As such, the inlet capstan 110 and the outlet capstan 112 may be substantially equidistant from the drive wheel axis 302, according to embodiments of the present invention. The inlet capstan 110 may also be identical to the outlet capstan 112, according to embodiments of the present invention. According to embodiments of the present invention, having the inlet capstan 110 and outlet capstan 112 being identical and/or placed in symmetrical locations with respect to the drive wheel axis 302 and rope inlets and outlets 206, 208 permits the descent device 100 to be reversible (e.g. to operate the same for both directions of rope 102 travel).

Figure 10A:
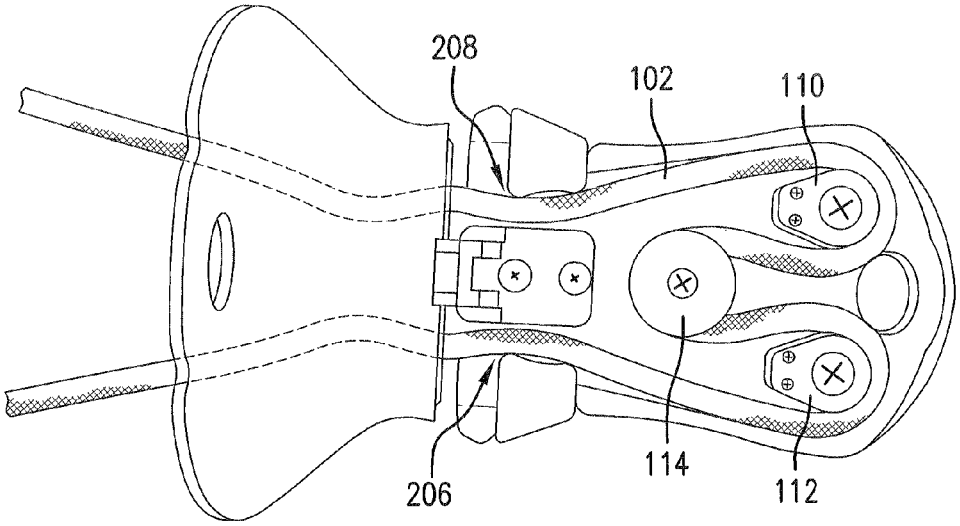
FIG. 10A illustrates a top view of an open descent device with rope fed therethrough, according to embodiments of the present invention.
Figure 10B:
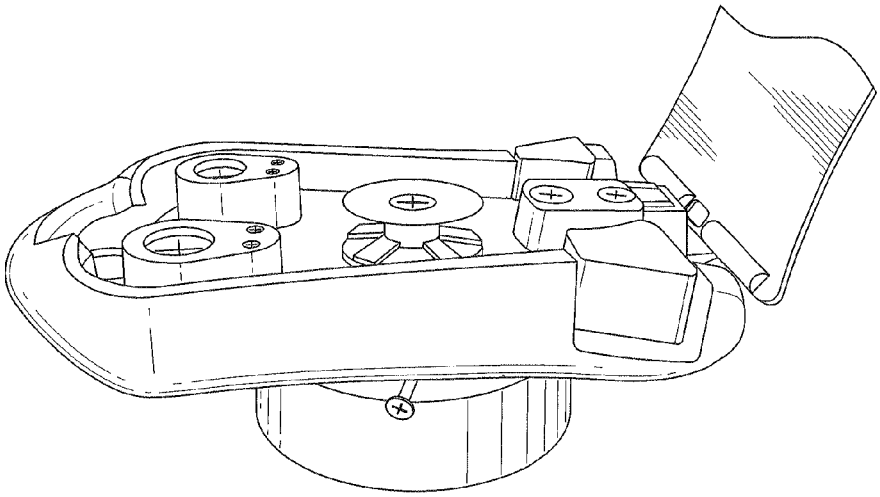
FIG. 10B illustrates a side perspective view of an open descent device 100, according to embodiments of the present invention.
Figure 11:
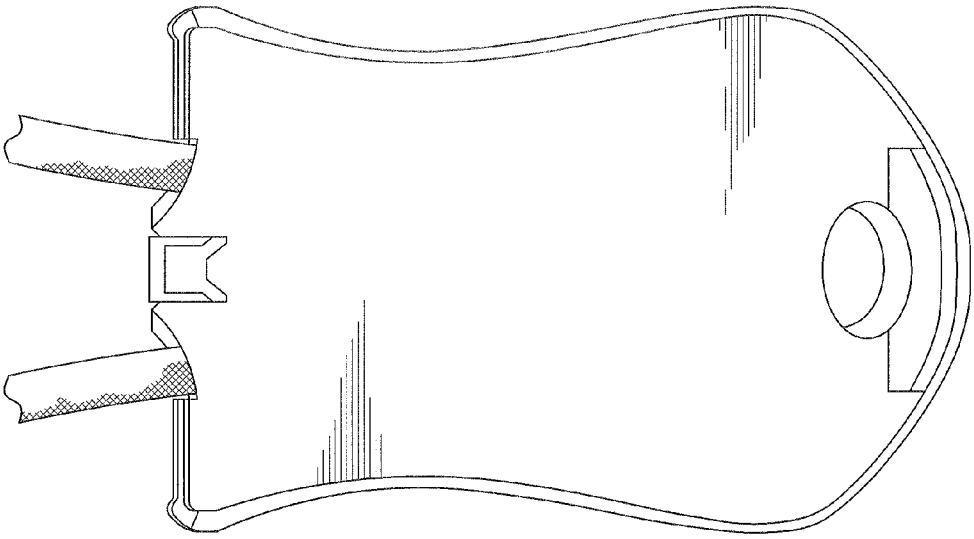
FIG. 11 illustrates a top view of a closed descent device showing the outside of the lid, according to embodiments of the present invention.
Figure 12:
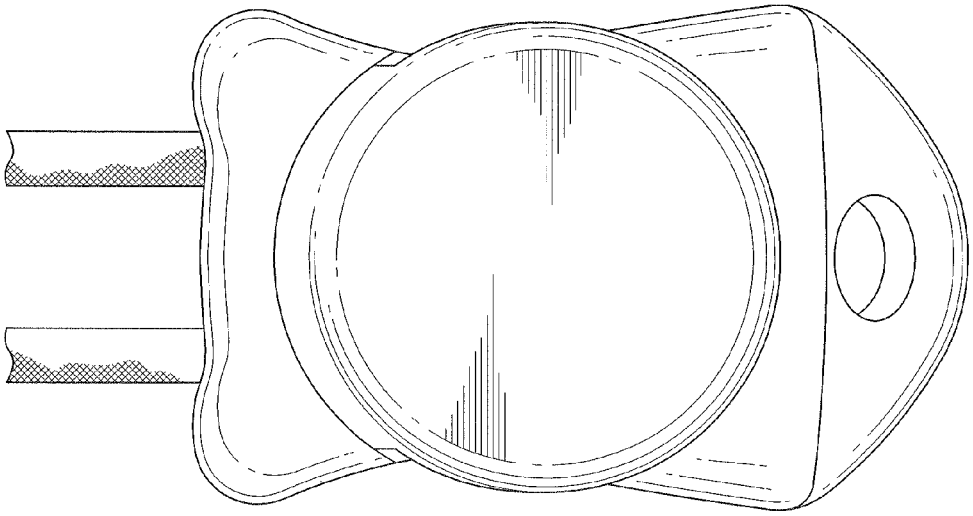
FIG. 12 illustrates a bottom view of a closed descent device showing the outside of the RDAEDD, according to embodiments of the present invention.

As illustrated in FIG. 10A, the rope 102 extends through the rope inlet 208, partially around the inlet capstan 110, partially around the groove 612 of the drive wheel 114, partially around the outlet capstan 112, and through the rope outlet 206, according to embodiments of the present invention.

RDAEDD and Strategically Placed Capstans

Capstans 110, 112 in the device may be strategically placed to a) minimize slip of the rope against the drive wheel 114 attached to the RDAEDD, and b) act as a multiplier to the braking force of the RDAEDD, according to embodiments of the present invention.

The sliding cam 104 generates a small amount of tension on the inlet of the rope 102. According to some embodiments of the present invention, depending on the load placed on the device, the amount of inlet tension on the rope 102 generated by the sliding cam 104 can be as low as zero or substantially zero and as high as 100 lbs; according to embodiments of the present invention, the inlet tension on the rope 102 is typically in the range between 5 lbs and 50 lbs. The inlet capstan 110, with about 200 degrees of wrap, acts as an approximate 2:1 multiplier to the 10 lbs of inlet tension so that the tension on the inlet side of the drive wheel 114 is about 50 lbs, which is enough to prevent slip between the rope 102 and the drive wheel 114, according to embodiments of the present invention. The braking force of the RDAEDD is additive to the braking force of the inlet tensioning device 104 and the inlet capstan 110, according to embodiments of the present invention. Descent speed is dependent on load and the braking force of the RDAEDD is dependent on descent speed. The braking force of the RDAEDD can be as little as zero at low speed, according to embodiments of the present invention. In a single-person descent device the braking force of the RDAEDD can add as much as 130 lbs of tension to the rope 102 using an F01 centrifugal brake manufactured by SUCO Robert Scheuffele GmbH of Keplerstrasse 12-14, 74321 Bietigheim-Bissingen Germany, as the RDAEDD.

Other centrifugal braking devices may be paired with a drive wheel 114 and configured to provide braking force according to rotational and/or translational velocity of the drive wheel 114, according to embodiments of the present invention. For example, a generator, wind vane, and/or water impeller may be used as an RDAEDD. When this RDAEDD braking force is added to the 50 lbs of tension on the inlet side of the centrifugal brake, the rope 102 force on the outlet side of the centrifugal brake can be as high as 180 lbs. This tension is then multiplied approximately 2:1 by the outlet capstan 112 so that the rope 102 tension at anchor is approximately 360 lbs at a descent speed of about 3 meters/sec, according to embodiments of the present invention. The device 100 operates at higher or lower descent speeds, according to other embodiments of the present invention. Based on the disclosure provided herein, one of ordinary skill in the art will appreciate that adjusting the friction characteristics of capstans 110, 112 by changing the material of construction, the shape or the number of degrees of wrap by the rope 102 can dramatically change the effective load range and speed of the descent device 100. Thus, the numbers used in this example serve to illustrate rather than define or limit the operation of embodiments of the device 100.

According to some embodiments of the present invention, capstan 112 may be eliminated to create a modified rapid descent system in which the primary braking force is supplied by the RADAEDD. According to such embodiments, the rope inlet tensioning system (parts 106, 108, 116) may or may not be included.

According to yet other embodiments of the present invention, capstan 110 may be eliminated to create a modified rapid descent system which uses other means to prevent the rope 102 from slipping against the drive wheel 114 that connects to the RDAEDD. Other means of preventing slip between the rope and the drive wheel include a compression roller or cam that actively presses the rope against the drive wheel, according to embodiments of the present invention. According to such embodiments, the drive wheel 114 (connected with the RDAEDD) is used to establish an initial braking force that is then multiplied by the rope exit capstan 112. According to such embodiments, the rope inlet tensioning system (parts 106, 108, 116) may or may not be included.

Rope Inlet Tensioning Device

The sliding cam 104 element of embodiments of the present invention is different from existing sliding cam devices in several ways, as described below.

Figure 9:
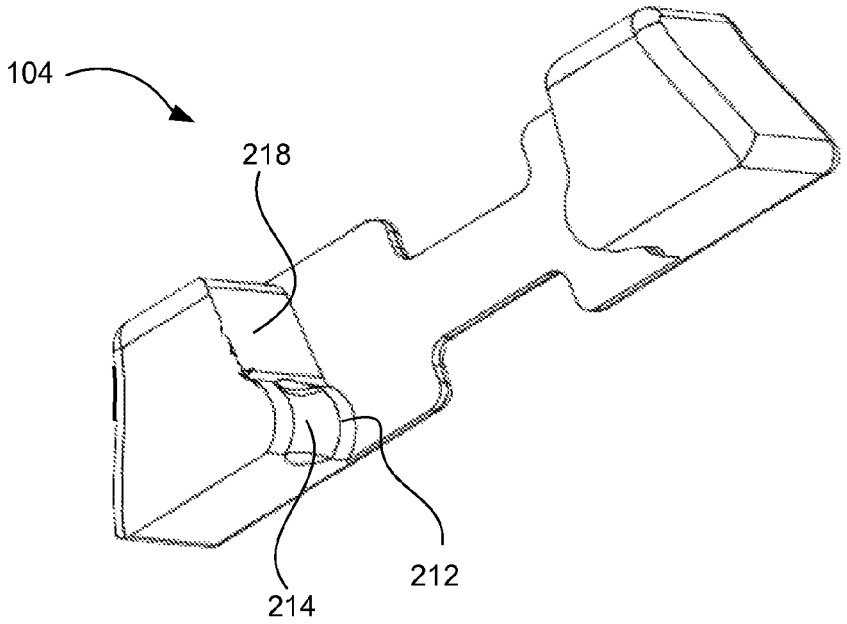
FIG. 9 illustrates an enlarged perspective view of a sliding cam, according to embodiments of the present invention.

According to some embodiments of the present invention, the inner faces of the sliding cam 104 that contact rope 102 are not flat. The two faces that come in contact with the rope 102 contain one or more convex dimples or protrusions 212, 216. Alternatively, the two faces may include concave dimples, concave protrusions and/or scallops (not shown), according to embodiments of the present invention. The protrusions 212, 216 in addition to protruding from the inner faces 218, 220 of the sliding cam 104, may also include slight valleys 214 along the protrusions 212, 216 to further guide and/or place the rope over the protrusions 212, 216 according to embodiments of the present invention. These protrusions 212, 216 dramatically reduce the friction of the rope 102 against the face of the sliding cam 104 while the tension in the rope 102 is low enough not to meaningfully distort the shape of the rope 102, according to embodiments of the present invention. This characteristic of the sliding cam 104 assembly makes it easy to manually pull rope 102 through the device 100 during what is called the "window-crawl test." When the tension in the rope 102 is enough to distort the rope 102 so that the fibers of the rope conform to, rather than ride over, the protrusions 212, 216 of the sliding cam 104, the friction between the rope 102 and the faces 218, 220 of the sliding cam increases dramatically and helps to generate the necessary inlet braking force that is then multiplied by capstans 110 and 112 to control descent speed, according to embodiments of the present invention. FIG. 9 illustrates a perspective view of the sliding cam 104 with an alternative angle view of the dimple 212, according to embodiments of the present invention. Conversely, scallops (not shown) formed in the face of the sliding cam 104 can dramatically increase the inlet tension of the rope. Whether to increase or decrease inlet tension on the rope 102 with the sliding cam 104 is determined by the objective of the end use of the device 100, according to embodiments of the present invention.

What is the "window-crawl test"? It is not uncommon for a firefighter or other rescue personnel to set up an anchor that is somewhat distant from the point of actual escape. In such cases, the firefighter sets up his anchor and then must crawl from the anchor to the window to escape. To make this crawl, it is often necessary to manually pull rope through the descent device 100. The amount of tension necessary to manually pull rope 102 through the descent device 100 while crawling to a window is ideally less than about 40 lbs., according to embodiments of the present invention. According to another embodiment of the present invention, the amount of tension to manually pull rope 102 through the device 100 while crawling to a window is less than twenty pounds. According to yet other embodiments of the present invention, the amount of tension to manually pull rope 102 through the device 100 while crawling to a window is less than ten pounds. Minimizing excessive back tension while passing rope through the device in this manner permits the user to more easily and conveniently move to a place of readiness for descent, according to embodiments of the present invention. According to embodiments of the present invention, during the window crawl test and/or during manual pulling of the rope 102 through the device 100, the sliding cam 104 is centered by, for example, rotating the device 100 such that the effect of the sliding cam 104 is neutralized, and/or by manually centering the sliding cam 104 by pressing on the end of the sliding cam 104.

According to some embodiments of the present invention, the sliding cam 104 is constructed of anodized aluminum. According to other embodiments of the present invention, the sliding cam 104 is constructed of steel or titanium. According to some embodiments of the present invention, titanium and steel are stronger, less prone to wear, have lower COF and provide better heat management properties as described herein. According to some embodiments of the present invention, the capstans 110, 112 are constructed of anodized aluminum. According to other embodiments of the present invention, the capstans are constructed of steel, titanium or copper. Each material has a different COF against rope. Titanium has the lowest COF followed by steel, then aluminum, and then copper. Selection of the material for the capstans affects the load range and descent speed of the device 100, according to embodiments of the present invention.

Figure 4:
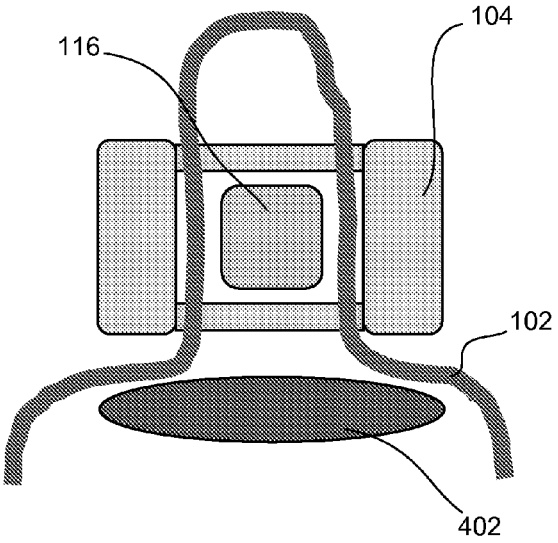
FIG. 4 illustrates a sliding cam mechanism.

As seen in FIG. 4, some existing devices include a circuitous rope inlet path; for example, the device of FIG. 4 includes a rope path guide 402 in front of the sliding cam 104 and anvil 116. The result is that any tension from the anchor on the exit side of the rope 102 forces the sliding cam 104 to slide, which puts inlet tension on the rope. This inlet tension acts as a force multiplier to all of the other braking elements in the device (the other braking elements are omitted from FIGS. 4 and 5 for clarity). One way to relieve this inlet tension to pass the window-crawl test with such a device is to manually center the sliding cam. The presence of the rope path guide 402 in front of the sliding cam 104 and anvil 116 permits such designs to develop a relatively large rope inlet tension when the load on the rope is very large.

Figure 5:
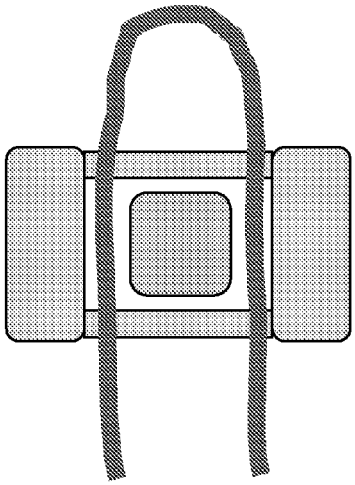
FIG. 5 illustrates a sliding cam mechanism according to embodiments of the present invention.

According to embodiments of the present invention, FIG. 5 illustrates a device without a rope path guide 402 in front of the sliding cam. The inlet and exit ropes are parallel or nearly parallel, according to embodiments of the present invention. This design minimizes the amount of rope inlet tension that can be developed when the rope is under load, according to embodiments of the present invention. According to embodiments of the present invention, when the device as shown in FIG. 5 is manually tilted so that the tension in the exit rope crosses the centerline of the device, all or nearly all of the inlet tension is relieved without manually centering the sliding cam. When the inlet tension is relieved in such a manner, the window-crawl test is passed with as little as 2 lbs of tension in the rope, according to embodiments of the present invention. According to embodiments of the present invention, the window-crawl test is passed with as little as five to ten pounds force of tension in the rope 102, depending on the type of rope used.

Heat Management

One common challenge for descent device design involves heat. Standard operating procedure during mountaineering descents is to never stop once started because the descent device can get so hot that it will melt through the rope. There are various ways to deal with heat during descent: 1) do not stop once started so no one part of the rope is in prolonged contact with the hot descent device, 2) build a descent device with enough mass to absorb the heat and keep the temperature of the device low enough to avoid damaging the rope, 3) build an energy dissipating device into the descent device that does not directly contact the rope, 4) insulate the parts of the descent device that would come in contact with the user, and/or 5) design a descent device that pushes a high proportion of the heat generated during descent directly into the rope as it is generated so that only a minimum of heat builds up in the descent device.

According to some embodiments of the present invention, the body 202 of the device 100 is constructed of aluminum and the capstans 110, 112 are constructed of titanium to produce heat management advantages. Aluminum conducts heat about fifteen times faster than titanium. During descent with device 100, the rope rubs directly against the titanium capstans 110, 112 and generates heat. The heat in the titanium capstans 110, 112 does several things: a) it heats the capstan 110, 112, b) it is conducted back into the moving rope 102 which cools the capstan 110, 112, and c) it is conducted into the aluminum body 202 of the device 100 and rapidly dispersed throughout the entire aluminum body 202 which cools the capstan 110, 112.

When descent is halted, several other things may happen: 1) heat from the titanium capstan 110, 112 is conducted back into the rope 102, raising the temperature of the rope 102 and lowering the temperature of the capstan 110, 112, and 2) heat from the aluminum body 202 is not conducted back into the titanium capstans 110, 112 because the rate of heat conduction back into the titanium is very slow. The titanium capstans 110, 112 are small having a mass of only about 30 grams, so they cannot store enough heat to damage rope 102 as long as their temperature is kept below about 250° F., according to embodiments of the present invention. In effect, constructing the capstans 110, 112 out of titanium causes them to act as one-way heat valves. The aluminum body 202 of the device 100 rapidly removes heat from the titanium capstans 110, 112, but because the conductivity of titanium is very low, heat from the aluminum body 202 is not conducted back into the titanium capstans 110, 112. Hence, embodiments of the present invention provide significant heat management. When both the capstans 110, 112 and the body 202 are made of aluminum, stopping descent can sometimes lead to thermal rope damage because the aluminum body of the device 100 is able to conduct a large amount of heat into the aluminum capstans relatively quickly.

Another way to manage heat generated during descent is to use copper capstans that are either thermally insulated from the body 202 of the descent device 100, or not thermally insulated from the body 202 of the descent device, according to embodiments of the present invention. If thermally insulated, the heat generated during descent is pushed back into the rope 102 rather than into the body 202 of the descent device. Thus, when descent is stopped, there is no meaningful amount of heat in the device to melt the rope 102, according to embodiments of the present invention. Conversely, if the mass of the descent device 100 is so large that it will not be heated to the point of being able to damage the rope 102 if descent is stopped, then promoting high conductivity between the capstans 110, 112 and the body 202 of the descent device 100 keeps heat from damaging the rope 102, according to embodiments of the present invention.

Coefficient of Friction

Anodized aluminum provides a relatively stable coefficient of friction ("COF"). However, when the anodizing wears away and presents bare aluminum to the rope 102, it no longer presents a stable COF to the rope 102. Aluminum oxidizes very rapidly—in seconds—and has a high COF. Unoxidized aluminum has a lower COF. When rope 102 is pulled over an unanodized aluminum capstan, the rope first experiences the high COF of aluminum oxide and it may be difficult to begin descent. Then, as the rope 102 rubs the surface of the capstan, it wears away the aluminum oxide and the rope 102 sees the lower COF of unoxidized aluminum which causes a fast descent. As soon as the descent pauses, aluminum oxide reforms and it may be difficult to reinitiate descent. This change in COF is difficult for automatic descent devices to handle. According to embodiments of the present invention, the capstans 110, 112 and other surfaces that rope rubs against (e.g. drive wheel 114) are replaced with titanium. The COF of titanium does not change because it does not undergo a dynamic oxidation process that changes during descent, according to embodiments of the present invention.

Flat Capstans

An advantage of dished capstans is that they help guide the rope 102 and keep it at the center of the capstan so that it does not rub against other parts of the device. So, some dish in capstans is often desirable. It would seem to some that capstans dished to the approximate same radius as the rope would create the least amount of friction. However, flat capstans have considerably lower friction than dished capstans. Embodiments of the present invention may employ capstans 110, 112 that are flat or only slightly dished to minimize low-load friction in order to increase performance during the window-crawl test. To minimize friction in order to increase performance in the window-crawl test, any dish in the surface of capstans 110, 112 in the descent device is at least twice the radius of the rope, according to embodiments of the present invention. According to other embodiments of the present invention, any dish in the surface of the capstans 110, 112 is three times the radius of the rope. According to yet other embodiments of the present invention, any dish in the surface of the capstans 110, 112 is four times or more the radius of the rope.

Drive Wheel

In a descent device that uses an RDAEDD, it is desirable to prevent slip between the rope 102 and the drive wheel 114 attached to the RDAEDD during steady-state operation. It is also desirable that the rope 102 be allowed to slip when impact loaded to relieve strain on both the rope 102 and the descending person/object. And, it is desirable that the rope 102 not be damaged when slip between the rope 102 and the drive wheel 114 occurs. A drive wheel 114 according to embodiments of the present invention may accomplish one or more of these three goals.

Figure 7:
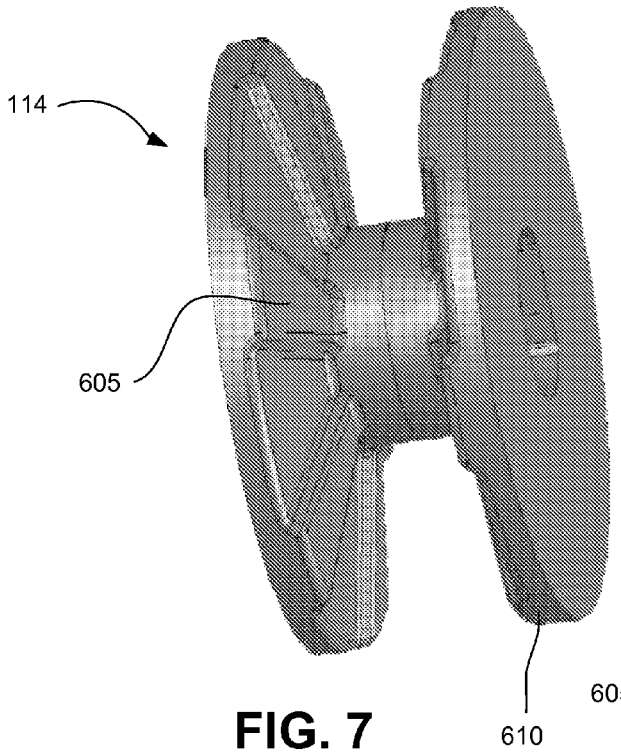
FIG. 7 illustrates a front perspective view of a drive wheel, according to embodiments of the present invention.
Figure 6:
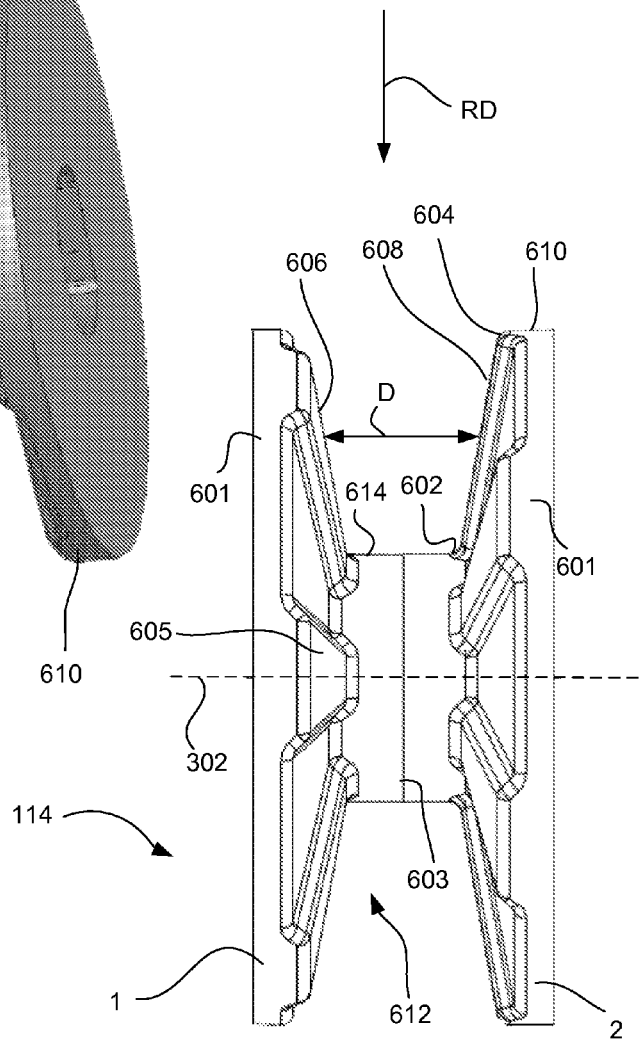
FIG. 6 illustrates a front plan view of a drive wheel, according to embodiments of the present invention.

FIGS. 6 and 7 illustrate enlarged views of a drive wheel 114, according to embodiments of the present invention. The drive wheel 114 incorporates a V-groove (see FIG. 6, the lower end 602 of the groove sidewall 601 is closer to the centerline 603 between the sidewalls 601 than the top end 604 of the sidewall 601, imparting a general V-groove shape) according to embodiments of the present invention. As tension on the rope 102 increases, the rope 102 is forced deeper into the V-groove, which increases side pressure on the rope and increases friction between the rope 102 and the drive wheel 114, according to embodiments of the present invention.

In other words, the drive wheel 114 includes an outer perimeter 610, and a groove 612 formed along the outer perimeter 610, according to embodiments of the present invention. The groove 612 includes a first inner side wall 606 and a second inner side wall 608, and a bottom 614, wherein a distance D between the first inner side wall 606 and the second inner side wall 608 decreases from the outer perimeter 610 to the bottom 614 in a radial direction RD toward the drive wheel axis 302, according to embodiments of the present invention. At least a portion of the radial extent (e.g. the extent of the groove 612 as measured between the drive wheel axis 302 and the outer perimeter 610) of the first inner side wall 606 and second inner side wall 608 includes a pattern of protrusions 605 positioned alternately between the first inner side wall 606 and second inner side wall 608 to form a serpentine rope path along the groove 612, according to embodiments of the present invention.

The drive wheel incorporates a series of alternating and opposing bars 605 that force the rope into a serpentine path as it wraps around the drive wheel 114, according to embodiments of the present invention. The serpentine path grips the rope 102 tightly and prevents and/or minimizes slip, according to embodiments of the present invention. Texture in the drive wheel 114 increases grip on the rope 102 without causing damage to the rope 102, according to embodiments of the present invention. Various combinations of these three features can be carefully controlled so that slip between the drive wheel 114 and the rope 102 is prevented and/or minimized at steady-state operating loads. However, device 100 may be configured to permit slip at operating loads that exceed safe design parameters, according to embodiments of the present invention. According to embodiments of the present invention, the serpentine path formed by the bars 605 may be referred to as an irregular path, which is a path for the rope that causes the rope to conform to one or more protrusions and/or indentations on the side walls 606, 608, as opposed to a regular rope path which would more closely resemble the path of a rope as it moves along a turning pulley or smooth wheel.

For a descent device that operates on an automatic basis (e.g. hands-free) for a wide range of loads and still maintains descent speed within a narrow operating range (0-4 meters/sec), it is desirable to provide an automatically-variable means of engaging the RDAEDD, according to embodiments of the present invention. The RDAEDD itself provides variable braking energy that is dependent on the speed that it rotates, according to embodiments of the present invention. A rope 102 driven drive wheel 114 that incorporates a carefully designed V-groove provides an additional mechanism for automatic variable speed control over the RDAEDD, according to embodiments of the present invention. Under light loads, the rope 102 rides at the outside diameter of the V-groove in the drive wheel 114, and under heavy loads, the rope 102 rides at the inside diameter of the V-groove in the drive wheel 114, according to embodiments of the present invention. The effect is that light loads cause the RDAEDD to spin slowly which causes the RDAEDD to develop minimal braking force, while under heavy loads the rope 102 is forced more deeply into the V-groove of the drive wheel 114, which causes the drive wheel 114 to rotate more quickly even at the same rope speed as with a light load. This causes the RDAEDD to spin faster and develop a larger braking force, according to embodiments of the present invention. The graph shown in FIG. 8 illustrates the concept. According to some embodiments of the present invention, the difference in RDAEDD rotational speed between low load and high load on the drive wheel is between 25% and 400%; according to other embodiments, the difference is between 50% and 200%; and according to yet other embodiments, the difference is between 75% and 150%.

According to embodiments of the present invention, the drive wheel 114 comprises a first half 1 including the first inner side wall 606 and a second half 2 including the second inner side wall 608, wherein the first half 1 is identical to the second half 2, and wherein the first half 1 is joined to the second half 2 at an angular offset, such that the pattern of protrusions 605 on the first half 1 do not directly align with the pattern of protrusions on the second half 2. According to embodiments of the present invention, the protrusions 605 are roughly trapezoidal in shape, with a longer top part near the outer perimeter 610 and a shorter bottom part near the bottom 614 with the longer top part and shorter bottom part connected by sides of substantially equal length. Accordingly, the voids in the side walls between the protrusions 605 are also roughly trapezoidal, in a similar fashion, according to embodiments of the present invention.

Although the pattern of protrusions 605 is described as being positioned alternately between the first and second inner side walls 606, 608, the pattern of protrusions 605 may alternatively be positioned synchronously (not shown) between the first and second inner side walls 606, 608. In such cases, the irregular rope path is a rope path in which a diameter of the rope 102 is compressed between two protrusions 605 of the pattern of protrusions at lengthwise intervals of the rope 102 along the groove 612.

Alternative Drive Wheel

FIGS. 13 and 14 illustrate an alternative drive wheel 1314, according to embodiments of the present invention. Similar to drive wheel 114, drive wheel 1314 also incorporates a general V-groove configuration. As tension on the rope 102 increases, the rope 102 is forced deeper into the V-groove, which increases side pressure on the rope and increases friction between the rope 102 and the drive wheel 1314, according to embodiments of the present invention.

The drive wheel 1314 incorporates a series of alternating and opposing bars 1305 that force the rope into a serpentine path as it wraps around the drive wheel 1314, according to embodiments of the present invention. These alternating and opposing bars 1305 may be similar to the alternating and opposing bars 605 of drive wheel 114, according to embodiments of the present invention. The serpentine path grips the rope 102 tightly and prevents and/or minimizes slip, according to embodiments of the present invention. Texture in the drive wheel 1314 increases grip on the rope 102 without causing damage to the rope 102, according to embodiments of the present invention. Various combinations of these three features can be carefully controlled so that slip between the drive wheel 114 and the rope 102 is controlled at various operating loads.

The brake drive wheel 1314 may be used for a rope- or cable-driven descent device, and may incorporate automatic "grip" and "slip" characteristics. The brake drive wheel has a general V-groove configuration so that greater load forces the rope deeper into the drive wheel 1314, which exerts greater pressure on the rope 102 and a higher level of friction to prevent slip. The interior rope-touching surfaces of the brake drive wheel 1314 also incorporate either a gradual or step transition from a smooth (low friction) surface at the outer diameter 1380 of the drive wheel 1314 to a variegated (high friction) surface at the inner diameter 1382 of the drive wheel 1314, according to embodiments of the present invention.

The brake drive wheel 1314 transmits force from the rope 102 to the brake in order to control descent. According to embodiments of the present invention, the brake drive wheel 1314 minimizes slip between the brake drive wheel 1314 and the rope 102 under circumstances of normal descent. However, some circumstances exist according to which some degree of slip between the brake drive wheel 1314 and the rope 102 are advantageous. For example, some degree of slip between the brake drive wheel 1314 and the rope 102 may be advantageous when the system is shock loaded. Shock loads can damage equipment and increase risk of injury.

According to some embodiments of the present invention, if the descent device 100 is shock loaded, the rope 102 slips over the brake drive wheel 1314 until the force is reduced to a level that will neither damage the device 100 nor injure the user. As another example, some degree of slip between the brake drive wheel 1314 and the rope 102 may be advantageous when the system has a very light load. Under very light loads, such as, for example, children, pets, or small objects, there may be enough friction in the descent system to prevent the load from descending. Allowing the rope 102 to slip against the brake drive wheel 1314 under very light loads can thus facilitate descent. Also, rope 102 is pulled manually through the system 100 under a variety of circumstances such as, for example, when rope 102 is being pulled manually through the system 100 when it is not under load. Most usually when an anchor is established some distance from the point of descent, the rope 102 is pulled through the device 100 to permit the user to move from the point of anchor to the point of descent. Under such conditions, it is advantageous to minimize friction in the system 100, and slip of the rope 102 over the brake drive wheel 1314 is one way to minimize friction.

Light loads or no load cause the rope 102 to stay at the outer perimeter 1380 of the brake drive wheel 1314 because considerable force is required to pull the rope 102 deep into the V-groove of the drive wheel 1314. Because the outer diameter 1380 of the brake drive wheel 1314 is deliberately a low-friction surface, the rope is deliberately allowed to slip against the drive wheel 1314 in these light or no load circumstances, according to embodiments of the present invention.

Under high loads, the force of the load pulls the rope 102 deep into the V-groove of the brake drive wheel 1314 where it encounters increased friction due to the increased surface friction of the drive wheel 1314, and/or due to the serpentine path imposed by alternating bars 105, according to embodiments of the present invention. The rope also encounters increased pressure, and hence, friction, because of the action of the V-groove. However, embodiments of the present invention control the degree of increased surface friction of the drive wheel 1314 so that it grips the rope 102 during normal descent, but slips against the rope 102 under shock load.

According to embodiments of the present invention, the combination of V-groove and surface friction of the brake drive wheel 1314 at its smallest diameter 1382 (where the rope rides under high load) is designed to grip the rope 102 at loads up to about 1000 lbf, and to slip at loads greater than about 1000 lbf. According to other embodiments of the present invention, grip is maintained at loads up to about 700 lbf and the rope 102 is permitted to slip at loads greater than about 700 lbf. According to yet other embodiments of the present invention, grip is maintained at loads up to about 600 lbf and the rope 102 is permitted to slip at loads greater than about 600 lbf. FIGS. 13 and 14 illustrate drive wheel 1314 which includes a step transition from a low-friction to a high-friction surface. However, many other sorts of step transitions are possible, and other variable transitions are also possible, according to other embodiments of the present invention.

Drive wheel 1314 includes an outer perimeter 1310, and a groove 1312 formed along the outer perimeter 1310, according to embodiments of the present invention. The groove 1312 includes a first inner side wall 1306 and a second inner side wall 1308, and a bottom 1314, wherein a distance between the first inner side wall 1306 and the second inner side wall 1308 decreases from the outer perimeter 1310 to the bottom 1314 in a radial direction toward the drive wheel axis 302, according to embodiments of the present invention. At least a portion of the radial extent (e.g. the extent of the groove 1312 as measured between the drive wheel axis 302 and the outer perimeter 1310) of the first inner side wall 1306 and second inner side wall 1308 includes a pattern of protrusions 1305 positioned alternately between the first inner side wall 1306 and second inner side wall 1308 to form a serpentine rope path along the groove 1312, according to embodiments of the present invention. According to embodiments of the present invention, the pattern of protrusions extends along the partial radial extent of the groove 1312 from the bottom 1314 to a predetermined radial distance M between the bottom 1314 and the outer perimeter 1310, wherein the first and second inner side walls are substantially smooth in the area A between the predetermined radial distance M and the outer perimeter 1310. According to embodiments of the present invention, the predetermined radial distance M is half of the radial distance between the bottom 1314 and the outer perimeter 1310.

Similarly to the drive wheel 114 described above, drive wheel 1314 may include a pattern of protrusions positioned synchronously between the first and second inner side walls 1306, 1308, and wherein the irregular rope path is a rope path in which a diameter of the rope 102 is compressed between two protrusions 605 of the pattern of protrusions at lengthwise intervals of the rope along the groove 1312, according to embodiments of the present invention.

According to embodiments of the present invention, a drive wheel stabilizer (not shown) may be included in the device 100. A drive wheel stabilizer is a metal element that attaches to the housing 202 above the drive wheel 114 and out of the path of the rope 102, according to embodiments of the present invention. If, under a shock load, the drive wheel 114 and/or the drive wheel shaft 210 experiences deflection, the drive wheel 114 impacts and is prevented from further deflecting by the drive wheel stabilizer, according to embodiments of the present invention. According to embodiments of the present invention, the drive wheel stabilizer prevents the drive wheel 114 from deflecting too far and breaking, and/or it serves as an indicator that a shock load has been experienced by the drive wheel 114, by leaving a mark on the drive wheel 114 that can be detected after use, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A descent device, comprising:

a rigid housing having a rope inlet and a rope outlet;

a shaft protruding through the rigid housing;

an inlet capstan rigidly coupled to the rigid housing;

a drive wheel attached to the shaft and coupled to a centrifugal brake, rotatable with respect to the rigid housing about a drive wheel axis and including a groove formed along an outer perimeter, wherein the groove has a first inner side wall, a second inner side wall, and a bottom, wherein a distance between the first and second inner side walls decreases from the outer perimeter to the bottom in a radial direction toward the drive wheel axis, and wherein at least a portion of a radial extent of the first and second inner side walls includes a pattern of protrusions on the first and second inner side walls to form an irregular rope path along the groove;

an outlet capstan rigidly coupled to the rigid housing; and a rope path extending through the rope inlet, partially around the inlet capstan, partially around the groove of the drive wheel, partially around the outlet capstan, and through the rope outlet;

wherein the pattern of protrusions is positioned alternately between the first and second inner side walls; and wherein the irregular rope path along the groove is a serpentine rope path, further comprising:

an anvil rigidly coupled to the rigid housing, the anvil forming at least part of the rope inlet and at least part of the rope outlet; and a sliding cam, the sliding cam slidably coupled to the rigid housing, the sliding cam comprising an inlet face that forms at least part of the rope inlet and an outlet face that forms at least part of the rope outlet, the inlet face configured to compress a rope between the inlet face and the anvil when the inlet face is slid towards the anvil.

2. The descent device of claim 1, wherein the inlet capstan comprises an inlet rope travel surface and an inlet capstan axis, wherein the inlet capstan axis is substantially parallel with the drive wheel axis, the inlet rope travel surface having a radius of curvature about the inlet capstan axis.

3. The descent device of claim 1, wherein the outlet capstan comprises an outlet rope travel surface and an outlet capstan axis, wherein the outlet capstan axis is substantially parallel with the drive wheel axis, the outlet rope travel surface having a radius of curvature about the outlet capstan axis.

4. The descent device of claim 1, wherein the inlet face comprises an inlet protrusion extending from the inlet face into the rope inlet in a direction substantially perpendicular to a rope travel direction, and wherein the inlet protrusion is configured to reduce friction between the inlet face and the rope when the rope is manually pulled through the descent device.

5. The descent device of claim 1, wherein the outlet face comprises an outlet protrusion extending from the outlet face into the rope outlet in a direction substantially perpendicular to a rope travel direction, and wherein the outlet protrusion is configured to reduce friction between the outlet face and the rope when the rope is manually pulled through the descent device.

6. The descent device of claim 1, wherein the inlet capstan is formed of a first material, wherein the rigid housing is formed of a second material, and wherein the first material has a lower thermal conductivity than the second material.

7. The descent device of claim 1, wherein the outlet capstan is formed of a first material, wherein the rigid housing is formed of a second is material, and wherein the first material has a lower thermal conductivity than the second material.

* * * * *